US005152681A

United States Patent [19]

Bishai

[11] Patent Number: 5,152,681

[45] Date of Patent: Oct. 6, 1992

[54] REVERSIBLE VANE PUMP WITH TWO PIECE ROTOR ASSEMBLY

[75] Inventor: Macram N. Bishai, Windham, N.H.

[73] Assignee: McCord Winn Textron Inc., Winchester, Mass.

[21] Appl. No.: 529,317

[22] Filed: May 29, 1990

[51] Int. Cl.[5] ..... F04C 18/344; F04C 27/00

[52] U.S. Cl. ..... 418/14; 418/110

[58] Field of Search ..... 418/14, 107, 110

[56] References Cited

U.S. PATENT DOCUMENTS

| | | | |
|---|---|---|---|
| 722,480 | 3/1903 | Bergmann | 418/110 |
| 1,020,842 | 3/1912 | Ogden | 418/110 |
| 1,528,075 | 3/1925 | Richer | 418/110 |
| 1,582,922 | 5/1926 | Freud | 418/110 |
| 1,972,744 | 9/1934 | Lister | 418/110 |
| 3,995,976 | 12/1976 | Ishizuka | 418/110 |

FOREIGN PATENT DOCUMENTS

| | | | |
|---|---|---|---|
| 61-66882 | 4/1986 | Japan | 418/179 |

*Primary Examiner*—John J. Vrablik

*Attorney, Agent, or Firm*—Reising, Ethington, Barnard, Perry & Milton

[57] ABSTRACT

A high pressure vane pump has a two-piece rotor enclosed by a housing having an inlet and an outlet and an eccentric ring for controlling the reciprocation of vanes in a guide part of the rotor; the eccentric ring is closed by opposite end plates and a moveable crown part of the rotor is supported on the guide part to provide four degrees of freedom between the guide part and the crown part including movement of the crown part axially of the guide part; movement of the crown part clockwise and counterclockwise of the guide part; and yaw movement of the crown part with respect to the vertical axis of the guide part. Rotation of the rotor causes the crown part to be shifted axially of the guide part to increase the pressure output of the pump at high speed operation and to reduce the frictional losses between the rotor and the housing during start-up.

5 Claims, 3 Drawing Sheets

FIG 3
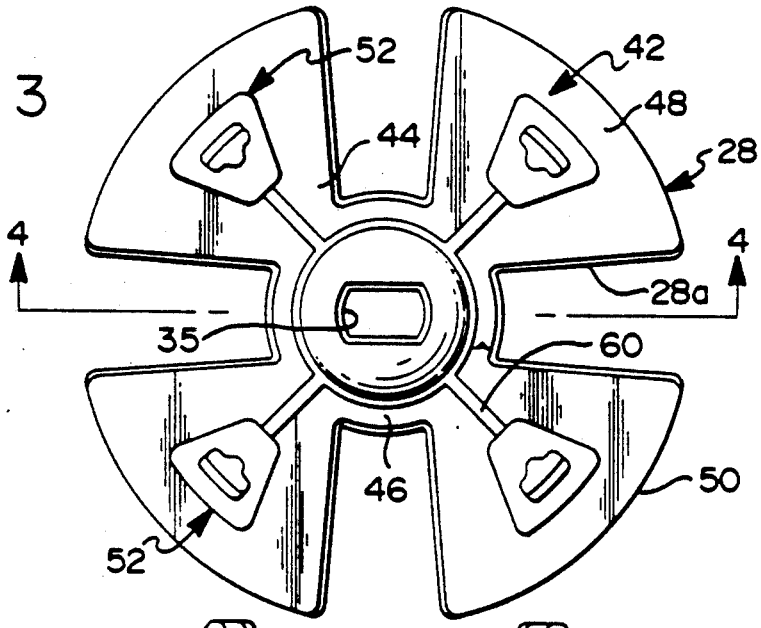
FIG 4
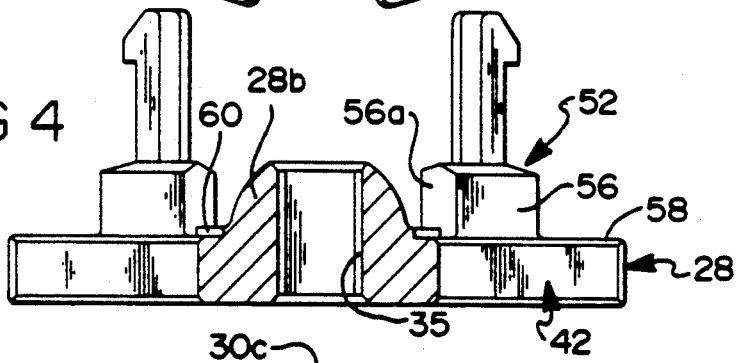
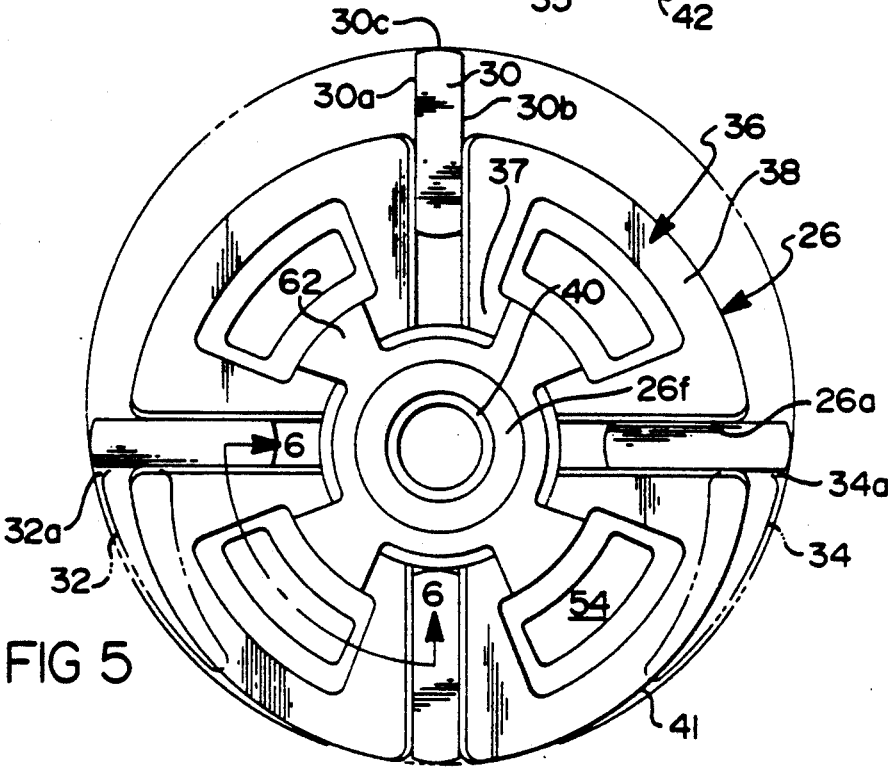
FIG 5

FIG 6
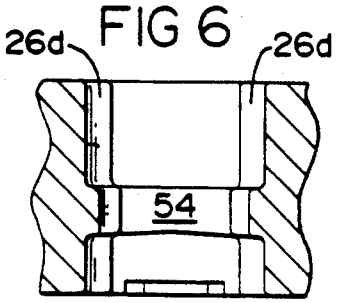
FIG 7
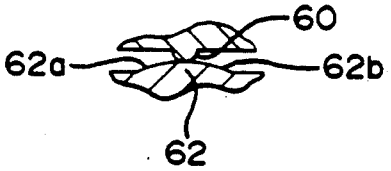
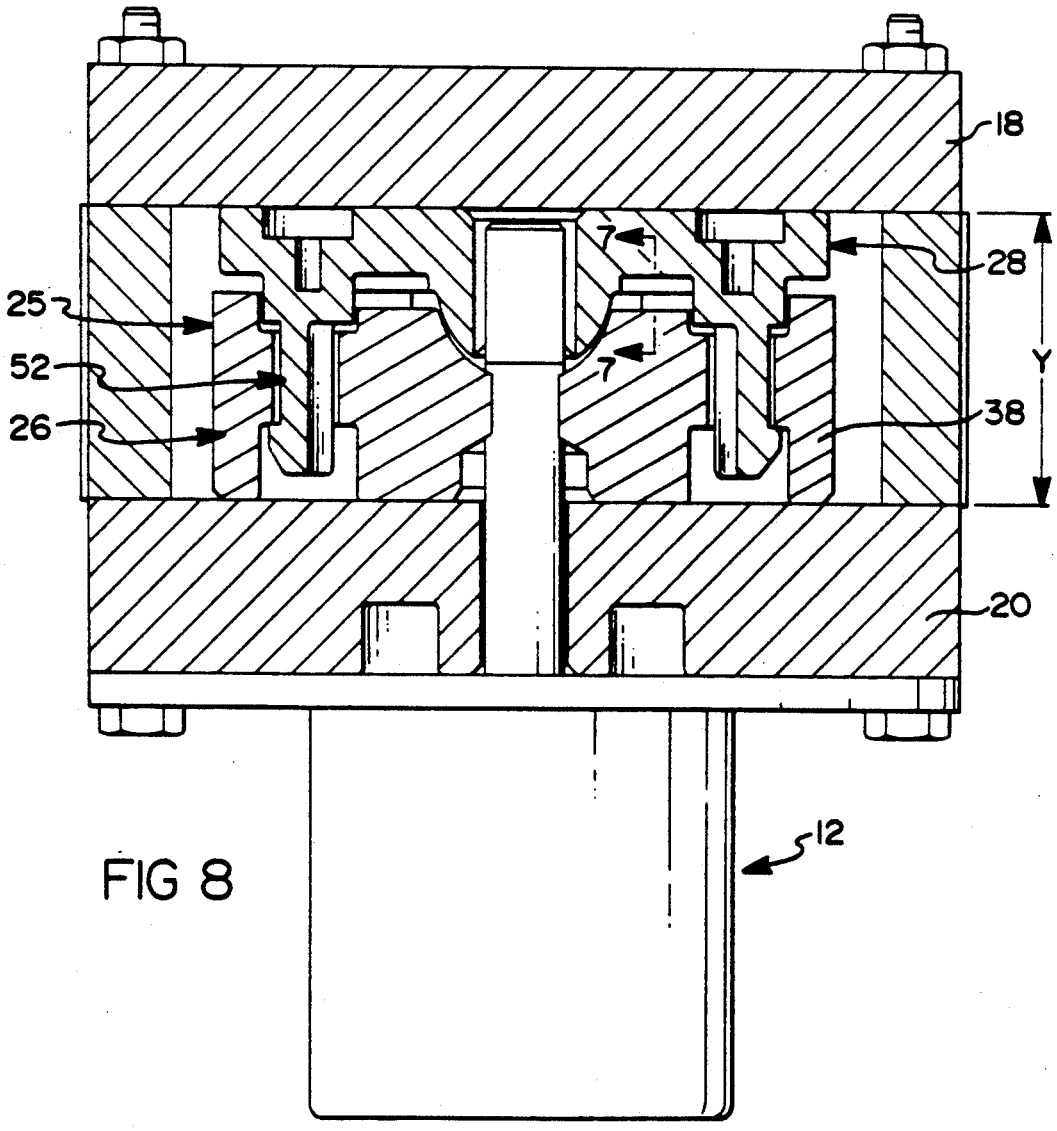
FIG 8

REVERSIBLE VANE PUMP WITH TWO PIECE ROTOR ASSEMBLY

FIELD OF THE INVENTION

This invention relates to high pressure pumps which are operative to charge and discharge pressurizable systems such as inflatable lumbar supports for vehicle seats and more particularly to high pressure vane pumps driven by reversible electrical motors.

BACKGROUND OF THE INVENTION

High compression vane pumps which are driven in opposite directions to pressure and deflate an associated system are characterized by having clearance between the moving and stationary parts of the pump. In order to reduce the need for expensive filtration units it is desirable to provide clearance between movable and stationary components so that they will be insensitive to contaminants in the stream of fluid being pumped. Moreover, another problem is how to reduce high starting torques in motor pump assemblies while retaining a desired high pressure output at high speed operation.

In known vane type pumps it has been necessary to provide close clearances between the moveable components of the pump and its stationary components. In such arrangements the reduced clearances for producing the high pressure discharge capabilities will create frictional drag between the moveable parts which in turn will produce a high starting torque that can only be produced by larger drive motors.

U.S. Pat. No. 4,253,809 discloses a two part rotor with end sealing surfaces. There is no provision in the pump for reducing friction only during start-up so as to reduce the need for larger drive motors.

U.S. Pat. No. 4,032,268 discloses a rotor supported by a plurality of axial thrust bearings to vary axial thrust and face clearance in accordance with engine temperature. It does not address the problem of how to reduce torque on engine start-up while maintaining engine compression when it is up to speed.

U.S. Pat. No. 3,528,757 discloses a rotor supported and positioned by a curved bearing and an adjustable screw for controlled axial clearance. Again there is no provision for reducing torque on start-up.

Japan 0066882 of Apr. 5,1986 entitled "Compressor with Ceramic Rotor" discloses a rotor having a steel shaft and a ceramic rotor part to control thermal expansion so as to maintain clearance between the rotor and the pump housing. The arrangement does not adjust clearance at start-up and at high speed operation.

While the aforesaid pump and rotor configurations are suitable for their intended purpose, e.g., thermal compensation to prevent excessive torque during high temperature operation, their is no provision therein to produce a change in the clearance between rotating and stationary components of a pump during start-up and at high speed operation of the pump.

SUMMARY OF THE INVENTION

Accordingly, a feature of the present invention is to provide a small compact easily manufactured electric motor driven pump assembly which has a reduced motor start load and which has a high discharge pressure when the pump is driven at high speeds.

Another feature of the present invention is an electric motor driven pump having a rotor with a crown part thereon which is positionable during start-up to reduce the start-up load on an electric drive motor.

A further feature of the present invention is to provide such a pump wherein the rotor has a two-piece assembly with a guide part and vane slots therein and a crown part disposed between the guide part and an end plate of the pump to adjust clearance between the rotor and the pump housing so as to reduce start-up load on the electric drive motor and to increase rotor sealing during high speed operation for increasing the output pressure or vacuum level in an associated pressurizable system and to furthermore, increase clearance between the rotor and the pump housing to enable the clearance gaps therebetween to be self-cleaned of particulate matter.

Yet another feature is to provide an electric motor driven pump of the type set forth in the preceding paragraph wherein the guide part has a cam follower and the crown part has a cam surface which coact as the motor starts to shift the crown part from a spaced relationship with the pump housing so as to maintain a low start-up load on the electric drive motor at low speed operation while producing a close clearance position with respect to the pump housing so as to reduce bypass leakage from a high pressure region in the pump to a low pressure region therein at high speed operation.

Yet another feature of the present invention is to provide electric motor driven pumps with the preceding features, wherein the guide part and crown part have a symmetrical design which will cause running clearance between the rotor and the pump housing to be adjusted in a like manner in either direction of rotation of the pump.

Still another feature is to provide such electric motor driven pumps wherein coacting surfaces between the guide part and the crown part of the rotor respond to centrifugal forces on the crown part to cause it to move axially with respect to an end plate of the pump so as to reduce the clearance between the end plate and the crown part to increase the discharge pressure at a pump outlet.

Another object of the present invention is to provide a motor driven vane pump as set forth above further characterized by the crown part having a flat surface on one end thereof adapted to be located in parallelism with the end plate and including a ball and socket for providing universal pivotal adjustment of the flat surface with respect to the end plate.

Yet another object of the present invention is to provide a motor driven vane pump further characterized by the crown part having a plurality of equidistantly spaced dependent arms thereon; slots formed in the guide part are directed axially therethrough at points therein located intermediate vane slots therein; each of the vane slots receives one of the dependent arms and a cam is operative for forcing the crown part to move axially of the longitudinal axis of the drive axis of the pump to reduce the clearance between the rotor and the end plate.

Another object of the present invention is to provide a motor driven vane pump further characterized by the rotor part having four wing segments thereon and a hub segment; the wing segments each have a smaller arcuate extent at the hub and a greater arcuate extent at the outer periphery of the guide part; the vane slots extend from the hub segment to the outer periphery of the guide part and have a constant width from the hub segment to the outer periphery; an opening directed axially through each of the wing segments includes surfaces for guiding both clockwise and counterclockwise relative rotation between the crown part and the guide part.

Still another object of the present invention is to provide a motor driven vane pump further characterized by the guide part having a raised rib thereon, and a cam surface on the crown part engageable with the rib to cause the crown part to be raised from the guide part as the crown part is relatively rotated with respect to the guide part.

These and other objects, advantages and features of the present invention will be more apparent when taken in conjunction with the following detailed description of the invention along with reference to the accompanying drawing wherein:

BRIEF DESCRIPTION OF THE DRAWINGS

FIG. 3 is a bottom elevational view of a crown part of the pump rotor in FIG. 2;

FIG. 4 is a sectional view of the crown part of FIG. 3 taken along the line 4—4 of FIG. 3 looking in the direction of the arrows;

FIG. 5 is a top elevational view of a guide part of the pump rotor in FIG. 2;

FIG. 6 is an enlarged fragmentary sectional view taken along the line 6—6 of FIG. 5 looking in the direction of the arrows;

FIG. 7 is an enlarged fragmentary sectional view taken along the line 7—7 of FIG. 8 looking in the direction of the arrows; and FIG. 8 is a view like FIG. 2 showing a pump rotor in its high speed position.

DETAILED DESCRIPTION OF THE PREFERRED EMBODIMENT

Figure 1:
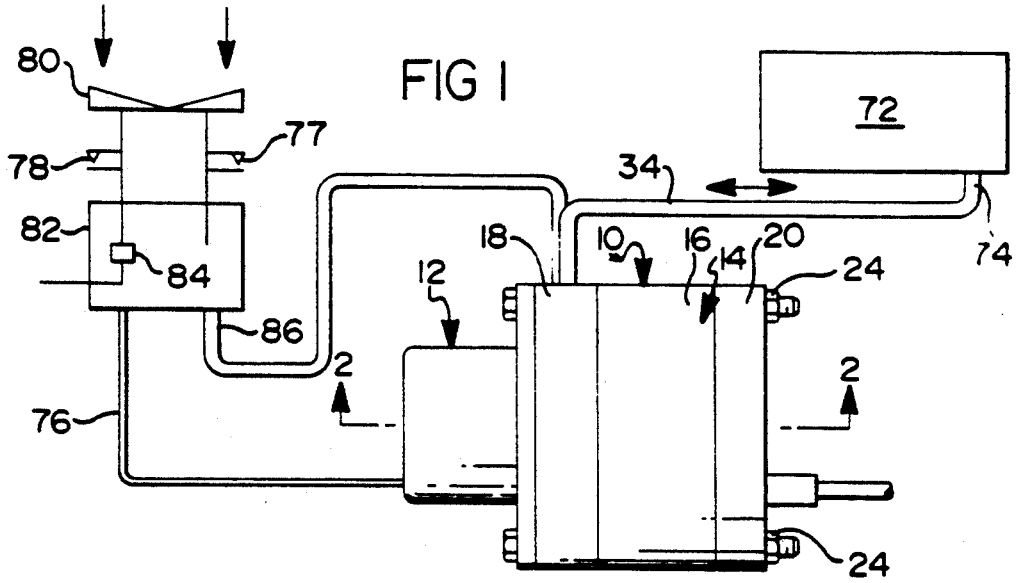
FIG. 1 is a perspective view of an electric motor driven pump including the present invention shown in association with a pumping system.

Referring now to FIG. 1 a motor driven pump assembly 10 is illustrated having a D.C. electric drive motor 12 connected to a vane type pump 14 including the present invention. The pump 14 has a stationary housing 16 with two opposite end plates 18, 20 having an eccentric ring 22 located therebetween. Suitable tie-bolts 24 are located at circumferentially spaced points on the stationary housing to join the end plates 18, 20 and eccentric ring 22 together in sealing relationship therebetween.

Figure 2:
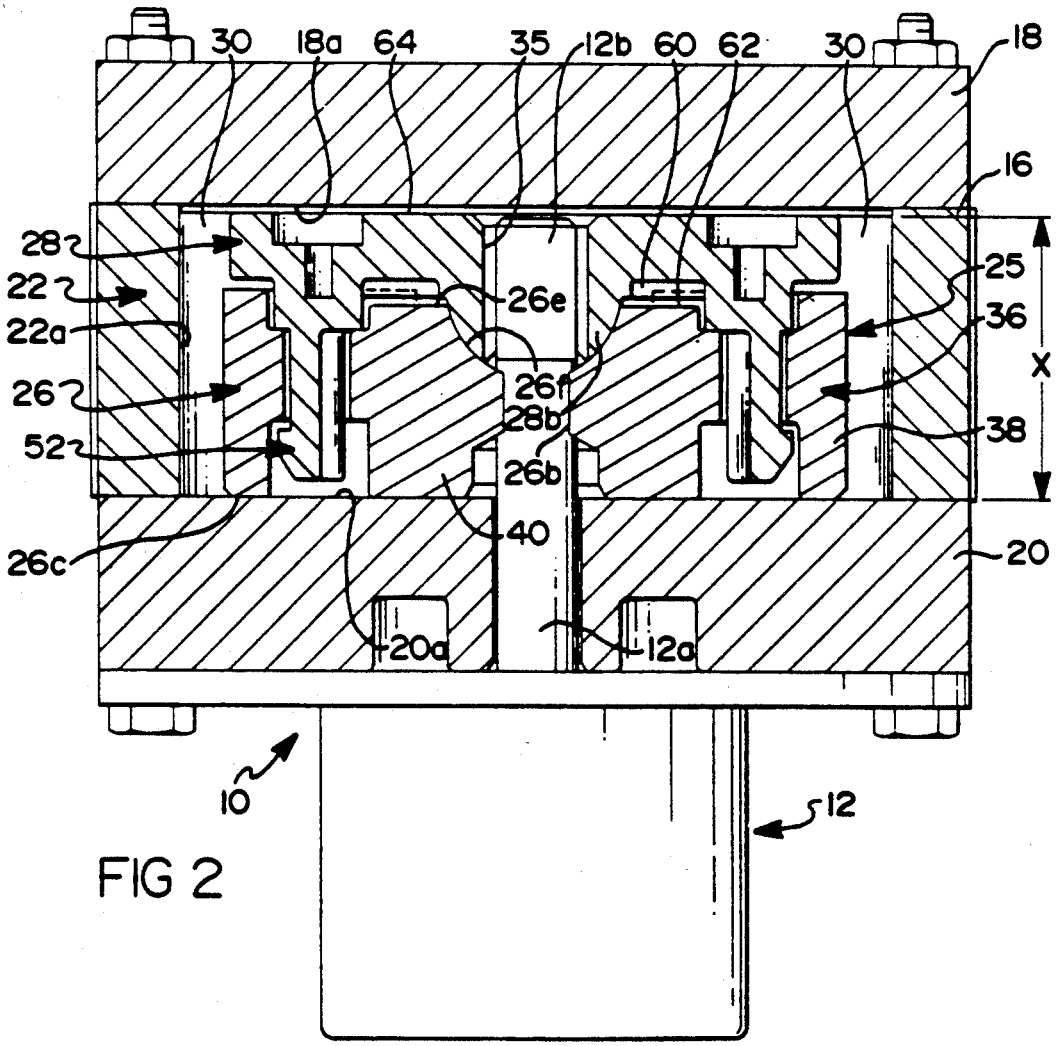
FIG. 2 is an enlarged sectional view taken along the line 2—2 of FIG. 1 looking in the direction of the arrows.

As shown in FIGS. 2 and 8, a two-piece rotor assembly 25 is located within the eccentric ring 22. The two-piece rotor assembly 25 includes a guide part 26 and a crown part 28 each having slots **26*a*, 28*a* for receiving pump vanes 30. The vanes 30 each have side walls 30*a*, 30*b* located in sliding engagement with the side walls of the slots 26*a* and 28*b*. The vanes 30 each have a vane tip 30*c* which is engaged by the inner surface 22*a* of the eccentric ring 22 such that rotation of the rotor assembly 25 will cause the vanes 30 to reciprocate into and out of the slots 26*a*, 28*a* and thereby draw fluid from a pump inlet 32 for discharge through a pump outlet 34 as best shown in FIG. 5. Each reciprocating vane 30 engages the eccentric ring as the rotor is rotated within the eccentric ring to form a contracting chamber 34*a* in communication with pump outlet 34 and to form an expanding chamber 32*a* in communication with a pump inlet 32** for drawing fluid therefrom for compression and discharge through the outlet.

In accordance with one aspect of the present invention, the guide part 26 and crown part 28 are configured so that the electric drive motor 12 of the motor driven pump assembly 10 will have a reduced start-up load. In particular, at start-up, the drive motor 12 has its output shaft **12*a* connected to the guide part 26 at a splined bore 26*b* therethrough. The output shaft 12 has a flattened extension 12*b* thereon that loosely fits in a guide slot 35 formed in the crown part 28 as best seen in FIGS. 2 and 3**.

The guide part 26 has an outboard surface **26*c* in a close tolerance relationship with the inboard surface 20*a* of the end plate 20. The close tolerance relationship is maintained by a press fit between guide part 26 and shaft 12*a* at splined bore 26*b*. The guide part 26 further includes four wing segments 36 thereon each having a small end 37 of less arcuate extent than a large end 38 thereon. The four wing segments 36 each have their small end 37 connected to a central hub 40 through which the bore 26*b* is formed. The wing segments 36 are spaced apart to form the vane slots 26*a* at a constant width from the central hub 40 to the peripheral surface 41 on each of the wing segments 36**.

Likewise, the crown part 28 has four wing segments 42 each having a small end 44 connected to a central hub 46 and each having a large end 48 at the outer peripheral wall 50 of the crown part 28 as best seen in FIG. 3 to form the vane slots **28*a* at a constant width which is larger than the width of the vane slots 26*a*. The greater width of vane slots 28*a* provides for limited relative rotation between the guide part 26 and the crown part 28**.

The guide part 26 and crown part 28 are loosely axially connected by four depending legs 52 on the crown part 28 formed at equidistant circumferentially spaced points therearound. Each depending leg 52 is inserted through one of a plurality of equidistantly, circumferentially spaced guide openings 54 in the guide part 26.

More specifically, the depending legs 52 and guide openings 54 are configured to coact to allow limited relative rotation between the guide part 26 and crown part 28 on motor start followed by axial movement of the crown part 28 upwardly of the guide part 26 as the vane type pump 14 is driven by the motor 12 from an initial at rest position shown in FIG. 2 to a high speed position shown in FIG. 8.

The depending legs 52 each include an upper end 56 integrally formed with the underside 58 of each of the wing segments 42. The upper end 56 has an arcuate reaction surface **56*a* thereon which is guided by a guide surface 26*d* on the guide member 26 to provide a track for relative rotational movement of the crown member 28 and the guide member 26 as the guide member is accelerated from an at rest position shown in FIG. 2 in either a clockwise or counterclockwise direction of rotation of guide member 26. As the guide member 26 accelerates the guide surface 26*d* will act on the reaction surfaces 56*a* on the depending legs 52 to cause the crown member 28 and the guide member 26** to be relatively rotated.

Such relative rotation will cause a plurality of cam follower ridges 60 on the underside 58 of the crown member 28 to engage inclined cam surfaces 62 on the guide member surface **26*e* so as to cause the crown member 28 to move axially upwardly of the guide member 26. The cam surfaces 62 have inclined surface portions 62***a*, 62*b* on either side thereof that will engage the cam follower ridge 60 to cause axial movement of crown member 28 in either direction of rotation of shaft 12*a*. As a consequence, a flat surface 64 on the crown member 28 is located closely adjacent the inboard surface 18*a* of the end plate 18 so as to reduce the amount of bypass between the vane slots 26*a*, 28*a* at the flat surface 64. In order to further assure uniform small clearance sealing, the crown member 28 has an integrally formed 20 hemispherically shaped ball portion 28*b* thereon. The ball portion 28*b* is seated in a hemispherically configured socket 26*f* formed in the guide part 26 as best seen in FIG. 2.

In operation, as the guide member 26 is accelerated, the aforesaid structure supports the guide part 26 and the moveable crown part 28 of the two-piece rotor 25 so as to provide four degrees of freedom between the guide part 26 and the crown part 28 including movement of the crown part 28 axially of the guide part 26; movement of the crown part 28 clockwise and counterclockwise of the guide part 26; and yaw movement of the crown part 28 with respect to the vertical longitudinal axis of the guide part 26.

The axial movement which is described above enables a large clearance gap to exist between the flat surface 64 and the end plate 18 at motor start. As a consequence the amount of drag between the moveable parts of the vane type pump 14 and the stationary housing 16 is reduced along with the start load on the motor 12. The motor load at full running speed is substantially less than at start-up since at rest friction is more difficult to overcome than running friction. Consequently, a smaller drive motor can be employed for a given pump capacity. Because of the aforesaid configuration the axial positioning of the crown part 28 will occur on either counterclockwise or clockwise drive of the motor 12 such that the vane type pump 14 can be driven to either pressure or depressure an associated pumping system.

For example, in the case of FIG. 1, the motor driven pump assembly 10 is associated with a pumping system 70.

The system 70 includes a 3 p.s.i. air cell 72, a reversible pump 14 driven by a motor 12, and a conduit 74 communicating between the pump and the air cell. Reversing mode type lead lines 76 are operatively connected between the motor 12 and pairs of contacts 77 and 78 of a two-position pneumatic switch 80 in a switch housing 82.

A normally closed bleed or exhaust valve 84 is mounted in the switch housing 82, operably connected to the contacts 78. A conduit 86 communicates between the bleed valve 84 and the pump 14.

In operation, when the contacts 77 of the switch 80 are manually engaged, the motor 12 is actuated via the lead lines 22 to drive the pump 14 so as to pump air through the conduit 74 to inflate the air cell 72 to a predetermined set pressure of, say, 3 p.s.i. Once this pressure is attained, the pump stops and the system is sealed by the normally closed bleed valve 84.

When it is desired to deflate the air cell 72, the contacts 78 of the switch 80 are manually engaged. This opens the bleed valve 84 and serves to reverse the polarity across the motor 12 to drive the pump 14 in the reverse direction. This power serves to bleed the system through the conduits 74 and 86 and the bleed valve 84. There is no need for a solenoid or relays in the system.

Specifically, clockwise rotation as viewed from the top of rotor 25 will draw fluid from the conduit 34. The conduit 34 is connected to atmosphere via exhaust valve 84 from whence air will be drawn and pumped for discharge through conduit 74 for inflating an air cell 72, for example, in a lumbar support for a vehicle seat. When the control switch 80 is positioned in its second control position, the contacts reverse the polarity across the motor 12 to cause it to rotate counterclockwise. Such rotation causes the rotor 25 to operate to draw fluid from the conduit 74 for discharge to atmosphere thereby to draw down the lumbar system. While a lumbar support system is shown as an associated pressurizable and depressurizable system it will be apparent that the present invention is equally suitable for use with other pumping systems, e.g., inflatable cushions for household furniture, hospital beds and the like.

Once the motor and pump are up to speed, the gap is closed between the flat surface 64 and the end plate 18. At the same time the crown part 28 is free to yaw about the vertical axis so as to cause the flat surface 64 to continuously tilt and adjust to the position of the inboard surface 18*a* of the end plate 18. Consequently, an improved seal is maintained even though the components are not initially positioned in a precise close tolerance relationship. Furthermore, because of the four degrees of freedom set forth herein, the rotor crown 28 only requires machining for flatness at the surface 64 and within reasonable commercial tolerances.

At zero speed, as shown in FIG. 2, the rotor height is at dimension X allowing ample clearance between the rotor 25 and the stationary end plate 18. Because of this ample clearance the vane type pump 14 is easily started since frictional losses are small as compared to those found in tight clearance pumps as set forth in the background of the invention. As a consequence of the present invention, a small no-load (or reduced load) starting torque is imposed on the electric motor 12 and this enables small motors to be used.

At higher speeds, the cam action between the cam follower ridges 60 and the inclined cam surfaces 62 (includes the inclined surface portion 62*a*, 62*b* thereof allows the rotor 25 to move either clockwise or counterclockwise depending upon motor polarity as established by the control switch 80. As the cam surfaces 62 force the crown part 28 higher, the rotor height becomes Y which is greater than X to reduce the clearance between the moving and stationary parts of the motor driven pump assembly 10. Consequently, the vane type pump 14 operates at higher discharge pressure. The symmetrical design of the guide part 26 and the crown part 28 will permit the crown part 28 to move in the same axial direction in either direction of motor drive to result in higher pressures during system pump-up or higher vacuum on system draw down.

The foregoing is a complete description of a preferred embodiment of the present invention. It should be understood, however, that various changes and modifications may be made without departing from the spirit and scope of the present invention as set forth in the following claims.

What is claimed is:

1. A motor driven vane pump having a rotor surrounded by a stationary pump housing including an eccentric ring and opposite end plates; the rotor including a plurality of vane slots each having a reciprocating vane therein with a tip portion engaging the eccentric ring for causing said vanes to reciprocate into and out of the rotor as it is rotated within the eccentric ring to form a contracting chamber in communication with a pump outlet and to form an expanding chamber in communication with a pump inlet for drawing fluid therefrom for compression and discharge through the pump outlet characterized by:

said rotor including a two-piece assembly with a guide part having the vane slots therein and a crown part disposed between said guide part and one of said opposite end plates;

plural pairs of opposed surfaces formed between said crown part and said guide part to provide movement between said crown part and said guide part for providing a first clearance between said crown part and said one of said opposite end plates during start-up for reducing loads on the drive motor during start-up;

one of said plural pairs of opposed surfaces responding after start-up to relative rotation between said guide part and said crown part to cause said crown part to move axially with respect to said one of said opposite end plates to reduce the clearance between said one of said opposite end plates and said crown part to increase the discharge pressure at said pump outlet.

2. The motor driven vane pump of claim 1, further characterized by said crown part having a flat surface on one end thereof adapted to be located in parallelism with said one of said opposite end plates; said plural pairs of opposed surfaces including a ball and socket for providing universal pivotal adjustment of said flat surface with respect to said one of said opposite end plates.

3. The motor driven vane pump of claim 1, further characterized by said crown part having a plurality of equidistantly spaced dependent part directed axially thereof at points therein located intermediate said vane slots therein; each of said guide openings loosely receiving one of said dependent legs; another of said plural pairs of opposed surfaces interposed between said dependent legs and said guide openings for rotating said crown part; and said one of said plural pairs of opposed surfaces including a cam surface on said guide part and a cam follower on said crown part responsive to said rotation of said guide part to cause said crown part to move axially of the longitudinal axis of said guide part to reduce the clearance between said rotor and said one of said opposite end plates.

4. The motor driven vane pump of claim 3, further characterized by said guide part having four wing segments thereon and a hub segment; said wing segments having a smaller arcuate extent at said hub and a greater arcuate extent at the outer periphery of said rotor part; the vane slots extending from said hub segment to said outer periphery of said guide part and having a constant width from said hub segment to said outer periphery; means forming an opening directed axially through each of said wing segments including means for allowing clockwise and counterclockwise relative rotation between said crown part and said guide part.

5. The motor driven vane pump of claim 4, further characterized by said cam means including a cam follower ridge on said crown part and cam surfaces on said guide part having side segments on either side of said cam follower ridge engageable with said cam follower ridge to cause said crown part to be raised from said guide part as said crown part is relatively rotated with respect to said guide part.

* * * * *